US006206207B1

(12) United States Patent
Kelley

(10) Patent No.: US 6,206,207 B1
(45) Date of Patent: Mar. 27, 2001

(54) PORTABLE SADDLE HOLDER

(76) Inventor: Peggy E. Kelley, 8202 Artie Kemp Rd., Frederick, MD (US) 21701

( * ) Notice: Subject to any disclaimer, the term of this patent is extended or adjusted under 35 U.S.C. 154(b) by 0 days.

(21) Appl. No.: 09/579,496

(22) Filed: May 30, 2000

(51) Int. Cl.[7] ..... A47F 7/00

(52) U.S. Cl. ..... 211/85.11; D30/135; D30/143; 248/174; 248/176.1

(58) Field of Search ..... 211/85.11, 13.1; 248/176.1, 174; D30/135, 143; D6/354

(56) References Cited

U.S. PATENT DOCUMENTS

D. 277,989 * 3/1985 Wakat .
D. 280,687 * 9/1985 Baldridge .
D. 316,919 * 5/1991 Reep ..... D30/143
D. 371,870 * 7/1996 Sylvester ..... D30/143
D. 377,548 * 1/1997 O'Shea ..... D30/143
D. 378,448 * 3/1997 Billings ..... D30/143
2,953,252 * 9/1960 Koontz .
4,432,459 * 2/1984 Coldren ..... 211/85.11

* cited by examiner

*Primary Examiner*—Robert W. Gibson, Jr.
(74) *Attorney, Agent, or Firm*—Michael W. York

(57) ABSTRACT

A portable saddle holder including a generally rectangular sheet of plastic material formed to have a generally parabolic shaped cross section taken perpendicular to the long axis of said folded sheet. The cross section has an upper portion shaped to form part of the circumference of a circle having a radius related to the tree width and associated panel spacing of the saddle. The height of the portable saddle holder is also related to the length of the flaps of the saddle.

14 Claims, 2 Drawing Sheets

PORTABLE SADDLE HOLDER

BACKGROUND OF THE INVENTION

Saddles are a critical piece of equipment for the sport of horseback riding and can also represent a significant financial investment. It is imperative that saddles always have adequate support to retain their shape and that the exposed surfaces, particularly on the underside are not damaged. Saddles consist of a number of parts. Those that are most relevant to the discussion of the invention are of the english type saddle. Of particular interest are the saddle tree which is the skeleton of the saddle and is usually made from wood, metal or a molded plastic, the saddle flaps which form the sides of the saddle, the pommel which is the front edge of the saddle, the cantle which is the rear edge of the saddle, and the panels which run the length of the saddle on the underside from the pommel to the cantle.

Generally speaking, when a saddle is not in use it is kept in a house, barn, or outbuilding. When kept in these locations it may be stored on a saddle rack mounted on a wall or other vertical surface or on a free standing saddle rack or stand. In addition, saddles may be placed over railings, on the back of a sofa or chair or sometimes just placed on the floor.

If the saddle is kept in close proximity to where the horse is located, the saddle may simply be carried and placed on the horse. In other instances, the saddle may be carried some distance by a person on foot and then placed in a temporary location until it is placed on the horse. In still other instances, the saddle may be transported in a vehicle and then removed and placed in a temporary location until it is placed on the horse. These temporary places may include a fence rail, a stall door, the side of a truck, a chair or even the ground. When a saddle is transported in a vehicle it is usually placed on a car or truck seat, in the trunk of a car or in the back of a sport utility vehicle, or in the bed of a pickup truck. In most if not all of these cases, there is no proper support available for the saddle.

Horses are oftentimes taken to temporary locations such as those associated with horse shows and trail rides. In these situations, the saddle may be placed on the horse, removed and placed in a temporary location and then placed on the horse again. This occurs frequently at horse shows when a horse is performing in several classes with a length of time between those classes. If a rider has no one else to help attend to the horse, he or she will not want to leave the horse while searching for an appropriate place to put the saddle. It is commonplace at horse shows for riders to place the saddle on the ground or on a fence rail because there is no convenient, suitable place to put the saddle. This is undesirable because the saddle can be damaged quite easily, but riders face the dilemma of not having something convenient to put the saddle on that will hold the saddle properly.

A variety of items have been created to support and store saddles under certain circumstances when the saddles are not being used. Among these is the type of saddle rack which must be attached to a vertical wall or other structure and projects horizontally to support a saddle placed thereon. Some of these are disclosed in prior U.S. patents including U.S. Pat. No. 2,953,252 and U.S. Pat. No. Des. 277,989. Another commonly used type of saddle stand or rack is one which rests on the floor and holds a saddle and may hold other horse-related equipment. Some of these are disclosed in prior U.S. patents including U.S. Pat. No. 4,432,459; U.S. Pat. No. 4,768,656; U.S. Pat. No. 5,165,553; and U.S. Pat. No. Des. 295,906. These two types of saddle racks or stands represent the most common structures for supporting a saddle when the saddle is not in use.

The first type described above is strictly limited in its utility because of its physical structure which requires that it must always be attached to a vertical structure in order to function. The second type which rests on the floor is more versatile in that it can be moved from one location to another without requiring other support. This type may be considered portable because it can be moved. Most often, this type of saddle rack or stand is manufactured of wood and is meant to be used indoors and not outdoors. Neither one of the types of saddle racks or stands can easily be carried as a single unit with the saddle and then be used as a free-standing saddle stand or holder.

These problems associated with the previous saddle holders have been alleviated with the present portable saddle holder that requires no permanent or temporary attaching apparatus and the portable saddle holder is readily used outdoors and can be transported with the saddle as a unit. The portable saddle holder invention has been formed and fabricated in such a way to properly support the important portions of the saddle at all times and to be carried concurrently with the saddle and then used to properly hold the saddle at any temporary location when the saddle is not being used on the horse. The invention can also be readily used to support the saddle during transport in a vehicle.

SUMMARY OF THE INVENTION

This invention relates to apparatus for supporting a saddle and more particularly to portable saddle holders that have a plurality of functions.

Accordingly, it is an object of the invention to provide a portable saddle holder that has other functions than just holding a saddle.

It is an object of the invention to provide a portable saddle holder that can be used to support saddles.

It is an object of the invention to provide a portable saddle holder that can be used to store saddles.

It is an object of the invention to provide a portable saddle holder that can be used to maintain the condition of saddles.

It is an object of the invention to provide a portable saddle holder that has proper contact support for a saddle.

It is an object of the invention to provide a portable saddle holder that properly supports different sizes of saddles.

It is an object of the invention to provide a portable saddle holder that properly supports different types of saddles.

It is an object of the invention to provide a portable saddle holder that is readily transported.

It is an object of the invention to provide a portable saddle holder that can be readily used to transport saddles.

It is an object of the invention to provide a portable saddle holder that can be readily used to transport saddles manually.

It is an object of the invention to provide a portable saddle holder that can be readily used to transport saddles in a vehicle.

It is an object of the invention to provide a portable saddle holder that can be readily used to store saddles in a variety of locations.

It is an object of the invention to provide a portable saddle holder that can be readily used to store saddles for both short and long time periods.

It is an object of the invention to provide a portable saddle holder that can perform its functions with out the need of other structures.

It is an object of the invention to provide a portable saddle holder that is self supporting.

It is an object of the invention to provide a portable saddle holder that protects the the saddle that it supports.

It is an object of the invention to provide a portable saddle holder that provides critical support for important areas of the saddle that it supports.

It is an object of the invention to provide a portable saddle holder that will support the saddle while the saddle is being cleaned.

It is an object of the invention to provide a portable saddle holder that can be used both inside and outside of buildings.

It is an object of the invention to provide a portable saddle holder that is not adversely affected by the weather.

It is an object of the invention to provide a portable saddle holder that is not adversely affected by cold weather.

It is an object of the invention to provide a portable saddle holder that is not adversely affected by hot weather.

It is an object of the invention to provide a portable saddle holder that is not adversely affected by rain or snow.

It is an object of the invention to provide a portable saddle holder that does not readily absorb water.

It is an object of the invention to provide a portable saddle holder that is not readily subject to damage.

It is an object of the invention to provide a portable saddle holder that is impact resistant.

It is an object of the invention to provide a portable saddle holder that is strong for its weight.

It is an object of the invention to provide a portable saddle holder that is easy to maintain.

It is an object of the invention to provide a portable saddle holder that is easy to clean.

It is an object of the invention to provide a portable saddle holder that can be compactly stored when it is not in use.

It is an object of the invention to provide portable saddle holders that can be compactly stored when they are not in use by nestling them together.

It is an object of the invention to provide a portable saddle holder that is maintenance free.

It is an object of the invention to provide a portable saddle holder that is rugged and reliable.

It is an object of the invention to provide a portable saddle holder that is simple to use.

It is an object of the invention to provide a portable saddle holder that is easy to manufacture.

It is an object of the invention to provide a portable saddle holder that is relatively inexpensive to manufacture.

These and other objects will be apparent from the portable saddle holder invention that includes a folded generally rectangular sheet of plastic material formed to have a generally parabolic shaped cross section taken perpendicular to the long axis of the folded sheet. The cross section has an upper portion shaped to form part of the circumference of a circle having a radius related to the tree width of the saddle. The height of the portable saddle holder is also related to the length of the flaps of the saddle.

BRIEF DESCRIPTION OF THE DRAWINGS

The invention will be hereinafter more fully described with references to the accompanying drawings in which.

DETAILED DESCRIPTION OF THE PREFERRED EMBODIMENT

Figure 1:
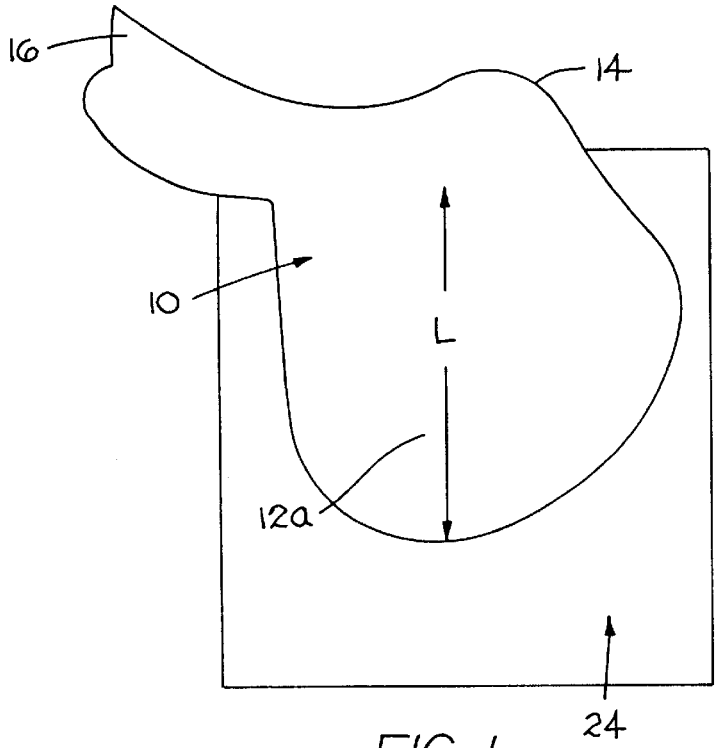
FIG. 1 is a side elevational view of the portable saddle holder invention supporting an english saddle.
Figure 3:
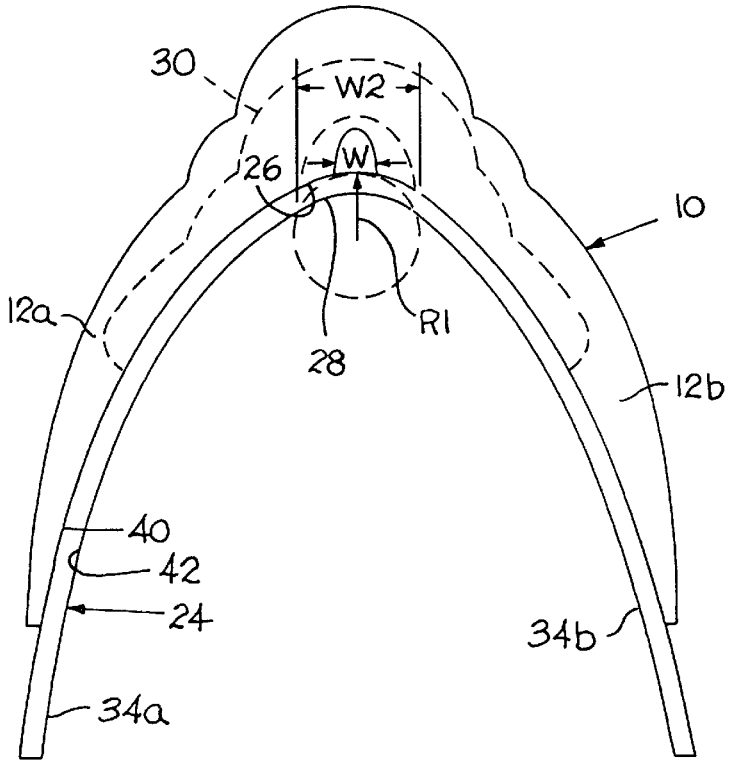
FIG. 3 is an enlarged view of a portion of the structure set forth in FIG. 2.
Figure 2:
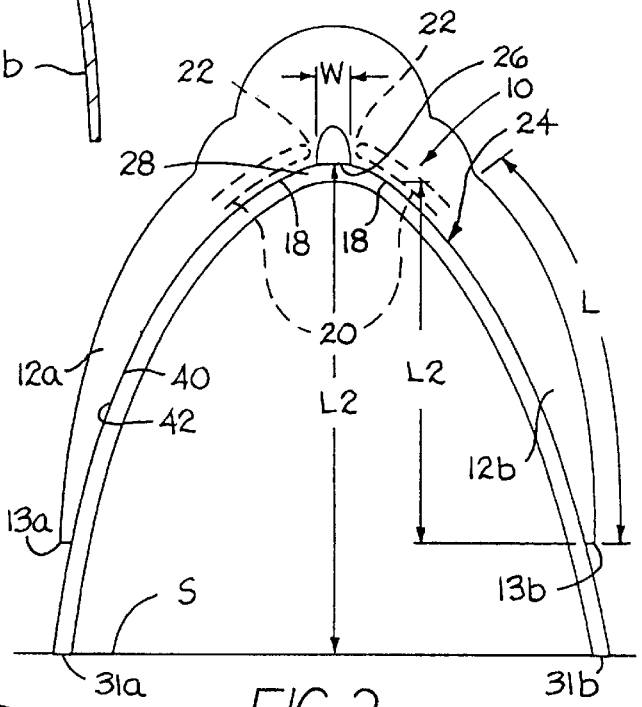
FIG. 2 is a front elevational view of the portable saddle holder invention supporting an english saddle set forth in FIG. 1.

FIGS. 1, 2 and 3 illustrate the important conventional parts of an english saddle 10. These parts are the saddle flaps 12*a* and 12*b* which form the sides of the saddle 10 and have a flap length designated by the letter L, the pommel 14 which is the front edge of the saddle 10, the cantle 16 which is the rear edge of the saddle 10, and the panels 18 which run the length of the saddle 10 from the pommel 14 to the cantle 16 on the underside. The saddle 10 is illustrated in FIGS. 1, 2 and 3 supported by the portable saddle holder invention that is designated generally by the number 24.

English saddles come in a variety of styles and sizes. The three basic elements of saddle sizing are (1) the size of the seat, (2) the width of the saddle tree and (3) the length of the saddle flaps. The latter two elements are the most relevant to the description of the portable saddle holder invention 24. The saddle tree 20 is the skeleton of the saddle and is usually made from wood, metal or molded plastic. Before a saddle is made, the width of the tree is measured between the two front points 22 of the tree 20. After the saddle 10 is constructed and the tree 20 has been covered and the panels 18 are in place on the underside of the saddle 10, a direct correlation exists between the width of the saddle tree 20 and the spacing between the upper edges of the panels 18. A wide tree saddle has a wider space between the panels 18. This spacing between the upper edges of the panels 18 is key to the following description of the portable saddle holder invention 24 and is designated by the letter W.

Modern day english saddles 10 come with a range of tree widths and associated panel spacings W and flap lengths L. This portable saddle holder invention 24 is capable of handling saddles 10 with a range of tree widths or panel spacings W and flap lengths L without any adjustments or the like. As best illustrated in FIG. 3, the outer curved surface 26 of the arch at the apex 28 of the portable saddle holder 24 is designed to accommodate most panel spacings W. This curved surface 26 at the apex 28 of the portable saddle holder 24 is shaped to have a cross section that forms part of the circumference of a circle C that has a radius R1 slightly larger than the radius R of the circumference of a circle that results from the panel spacing W of a wide tree width saddle 10. This circumference C should be formed by an arc A between 35 degrees and 45 degrees and in the preferred embodiment substantially by an arc of 40 degrees.

The larger radius R1 of the arch will support various panel spacings W. A saddle 10 with a narrow panel spacing W will rest slightly higher on the portable saddle holder 24. This saddle 10 with a narrow panel spacing W is illustrated in solid lines in FIG. 3. A saddle 10 with a wide panel spacing will rest lower on the portable saddle holder 24 as indicated by the dashed lines for the saddle 30 that has the wide panel spacing W2. It has been unexpectedly determined that the radius R1 of the cross section of the portable saddle holder 24 should be related to the saddle panel spacing W of the expected tree width saddle 10 as follows:

$$R1=B(W/2)$$

$$1.15 \leq B \leq 3.25$$

This permits the saddle holder 24 to accept a range of different tree width saddles 10 with a range of panel spacings W. In general, the higher values of B would be used where it was anticipated that the saddle holder 24 would be used with saddles having narrower saddle widths and panel spacings W.

As indicated in FIG. 2, it is important for the proper functioning of the portable saddle holder 24 that the distance, designated by L1, from the apex 28 of the arch of the portable saddle holder 24 to the supporting surface S be greater than the distance L2 from the upper edges 20 of the panels 18 of the saddle 10 to the bottom edge 13*a* or 13*b* of the respective saddle flap 12*a* or 12*b* on a saddle 10 with long flaps 12*a* and 12*b*. This proportionate difference allows the saddle 10 to be placed on the portable saddle holder 24 without the saddle flaps 12*a* and 12*b* touching the supporting surface S for the portable saddle holder 24. In order to prevent the flaps 12*a* and/or 12*b* from touching the portable saddle holder 24 supporting surface S it has been unexpectedly determined that the distance L1 from the apex 28 of the arch of the saddle holder 24 to the plane formed by the bottom edges 31*a* and 31*b* of the saddle holder 24 be related to the expected flap length L of the saddle as follows:

$$L1=A \times L$$

$$1.10 \leq A \leq 1.57$$

Figure 5:
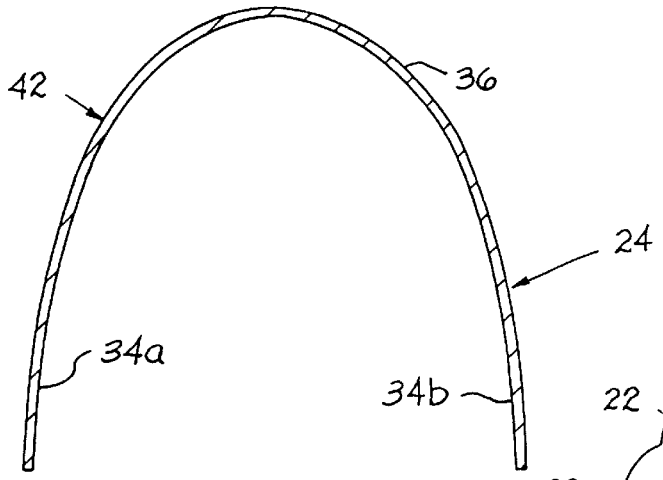
FIG. 5 is a sectional view of the portable saddle holder taken substantially on the plane 5—5 illustrated in FIG. 4.
Figure 4:
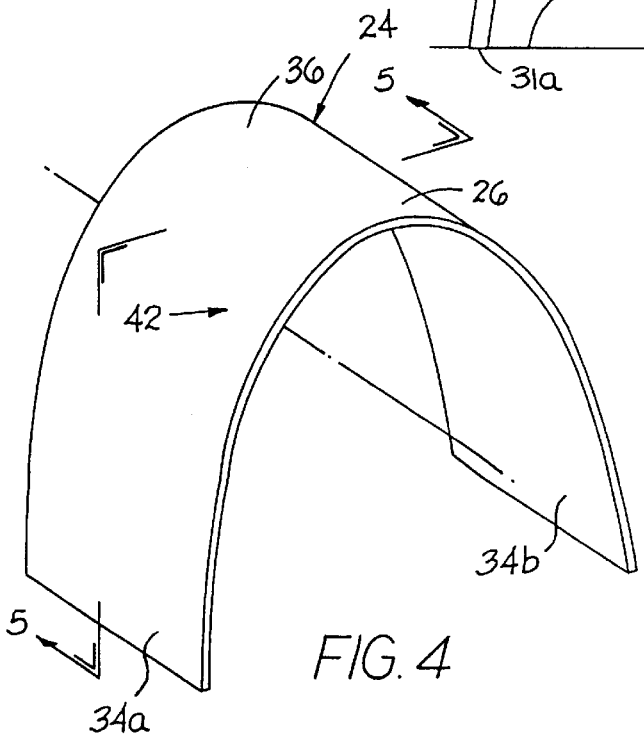
FIG. 4 is a perspective view of the portable saddle holder invention.

As best illustrated in FIGS. 4 and 5, the portable saddle holder 24 has completely solid flat sides 34*a* and 34*b* that are connected to and spaced apart by a curved top portion 36 that has the previously described semicircular surface 26. In view of this construction, saddles 10 with either narrow or wide panel spacings W will rest securely on the portable saddle holder 24 because of the maximum contact between the underside surface 40 of the saddle 10 and the outside surface 42 of the portable saddle holder 24. This maximum contact between the saddle 10 and the portable saddle holder 24 has two major benefits. First, it causes the saddle 10 to remain securely on the portable saddle holder 24 and not tilt significantly to one side or the other. Second, it helps to retain the shape of the saddle 10 and prevent the saddle flaps 12*a* and 12*b* from curling.

Also, the sides 34*a* and 34*b* of the portable saddle holder 24 that are solid and flat are also wider than the flaps 12*a* and 12*b* of a saddle 10 as well as being longer than the flaps 12*a* and 12*b*. These proportions permit the saddle 10 to rest securely on the portable saddle holder 24. As previously indicated, the distance from the apex 28 of the arch of the portable saddle holder 24 to the plane formed by the bottom edges 31*a* and 31*b* of the saddle holder 24 is longer than the distance from the upper edges 20 of the panels 18 of the saddle to the bottom edge 13*a* or 13*b* of the saddle flap on a saddle with long flaps 12*a* and 12*b*. This proportionate difference not only allows the saddle 10 to be placed on the portable saddle holder 24 without the saddle flaps 12*a* and 12*b* touching the supporting surface S which is not good for the flaps 12*a* and 12*b* but it also allows the saddle 10 to fit securely on the portable saddle holder 24 that would not occur if the saddle flaps 12*a* and/or 12*b* contacted the surface S.

The construction of the portable saddle holder 24 allows it to perform a number of functions. These functions are: (1) as a saddle carrier; (2) as a free standing support; (3) and as an auxiliary support or support adapter for a saddle 10. The physical properties of the portable saddle holder 24 which permit it to be used as a carrier are the hollow or open underside of the arch or center or top portion 36 which permits the saddle holder 24 to be placed over a person's arm and be carried with a saddle 10 or held at the edges of the apex by the hands of a person and carried with a saddle 10. Due to its construction, the portable saddle holder 24 is lightweight and weighs approximately four pounds. This light weight construction means that the combined weight of a saddle 10 and the portable saddle holder 24 is manageable by virtually anyone wanting to carry a saddle 10.

The physical properties which permit portable saddle holder 24 to be used as a free standing saddle support are as follows. The portable saddle holder 24 is molded from PVC which can be used indoors and outdoors without any damage to the portable saddle holder 24. This is possible since when heated and formed on a mold, then cooled, the PVC retains the shape to which it has been molded. The portable saddle holder 24 molded from PVC retains its molded shape while supporting a saddle 10 on a suitable surface S. In this manner, the portable saddle holder 24 serves as a free standing saddle 10 stand.

The physical properties which permit the portable saddle holder invention 24 to function as an auxiliary support or support adapter are as follows. The hollow or open arch shape of the portable saddle holder 24 permits it to be placed over prior art wall mounted saddle holders (not shown). The portable saddle holder 24 provides support for the entire saddle 10 including the full length of the saddle flaps 12*a* and 12*b*, which is not provided by the traditional wall mounted saddle holder.

The portable saddle holder 24 is made and used in the following manner. A rectangular sheet of PVC is formed by heating and bending it into the shape illustrated in FIGS. 4 and 5 using conventional plastic heat forming techniques and the sheet is allowed to remain on the mold until it has cooled. The material from which the sheet that is molded is moderately expanded rigid polyvinyl chloride (PVC) is known by the brand names Versacel, Sintra, Celtec and Komatex that are available from a variety of plastics distributors. This material becomes soft and pliable when heated and, after cooling on a mold, the material again becomes rigid and will support weight. The molded PVC sheet has a memory and will spring back to the molded shape if the sides are spaced apart. In addition, the PVC material resists moisture. This is a significant feature because when a saddle 10 is on the horse, there is a saddle pad between the saddle 10 and the horse and that saddle pad absorbs perspiration from the horse's back. However, the saddle 10 and pad can be taken off the horse and put directly on the portable saddle holder 24 with no concern whatsoever that the perspiration from the saddle pad may damage the portable saddle holder 24.

Since horseback riding is a year-round sport, it is critical that the portable saddle holder 24 remain durable at lower temperatures. Due to its nature, under normal winter conditions, no serious embrittlement of the PVC occurs. Also, elevated temperatures such as those experienced at an outdoor horse show in the summer in a warm climate have no effect on the PVC material from which the portable saddle holder 24 is constructed. Consequently, the portable saddle holder 24 can be used under virtually all climatic conditions.

The traditional methods for carrying an english saddle 10 are over the forearm of one arm, with the hand of the other arm holding the cantle 16 of the saddle 10 or using both hands with one hand holding the pommel 14 and the other holding the cantle 16. Since the arch at the apex of 28 the portable saddle holder 24 is molded to form a curved surface 26, the portable saddle holder 24 can rest easily on a person's forearm and be steadied at the outer top edge with the hand of the opposite arm. The hollow arch also permits the use of both hands to pick up and carry the saddle 10 and portable saddle holder 24 together. Thus the portable saddle holder 24 and the saddle 10 can be carried as a single unit in the ways that simulate the traditional methods of carrying the saddle 10 itself.

Since the portable saddle holder 24 supports the full underside of the saddle 10, including the flaps 12a and 12b, and has an open underside, as previously indicated it can be placed with the saddle 10 over the standard wall mounted saddle rack which normally only supports the saddle 10 horizontally along the panels 18 of the saddle 10. Thus the shape of the entire saddle 10 can be supported during storage by placing the saddle holder 24 on the standard wall mounted saddle rack (not shown). If there is no requirement that the saddle 10 be placed on a wall mounted storage rack, the portable saddle holder 24 can be used as a free-standing storage saddle stand that can rest on the floor or on a shelf of suitable width.

When a saddle 10 is in use, the critical contact points between the saddle 10 and the horse are the panels 18. The panels 18 of the saddle 10 should distribute the weight of the rider evenly along either side of the horse's backbone. As previously indicated, the portable saddle holder 24 is constructed in such a manner and has sides 34*a* and 34*b* of such size from front to back to allow the panels 18 of the saddle 10 to rest securely on the outer surface of the portable saddle holder 24.

Since the portable saddle holder 24 is "hollow" or open with no bottom, if need be, the saddle 10 and portable saddle holder 24 can be placed as a single unit over any suitable structure and the underside of the saddle 10 will be protected from being damaged. The portable saddle holder 24 will support the shape of the saddle 10 in its entirety at all locations where the saddle 10 may be placed.

As a space-saving feature, the open bottom design of the portable saddle holder 24 allows it to be placed in a free-standing manner over other items of horse-related equipment and supplies (not shown). These items may include a brush box which is generally rectangular in shape and holds brushes and other types of supplies and a duffle-type bag which can hold chaps; a hard hat; gloves and the like. If desired, the portable saddle holder 24 can easily be shortened in height by employing commonly used sawing techniques. This feature is useful when the saddle 10 and portable saddle holder 24 are to be transported in an automobile trunk which has height limitations. This feature is also useful in any other circumstance where there is a height restriction.

Figure 6:
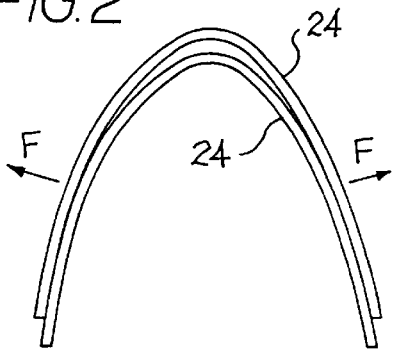
FIG. 6 a front elevational view of the portable saddle holders illustrated in FIGS. 1 through 5 illustrating how they can be stacked together.

As illustrated in FIG. 6, when the portable saddle holders 24 are not in use and they are being stored or transported without saddles 10, they can be nestled together by placing one portable saddle holder 24 on top of another saddle holder 24 to form a compact package. This is possible since the saddle holder 24 has an open arch that will accept the apex portion of a saddle holder 24 located below it and since the saddle holder 24 has flexible sides 34*a* and 34*b* that will move outward in the directions indicated by the arrows F to accommodate the sides 34*a* and 34*b* of the saddle holder 24 located below it.

Although the portable saddle holder 24 invention has been described in connection with the use of polyvinyl chloride or PVC in the preferred embodiment, it is possible that other suitable materials could be substituted for polyvinyl chloride or PVC.

Although the invention has been described in considerable detail with reference to a certain preferred embodiment, it will be understood that variations or modifications may be made within the spirit and scope of the invention as defined in the appended claims.

What is claimed is:

1. A portable saddle holder for a saddle having a saddle tree with a tree width and associated panel spacing and flaps with a flap length comprising a folded generally rectangular sheet of plastic material formed to have a generally parabolic shaped cross section taken perpendicular to the long axis of said folded sheet, said cross section having means for holding saddles with different tree widths and associated panel spacings.

2. The portable saddle holder of claim 1 wherein said plastic sheet is formed to provide means for supporting said saddle.

3. The portable saddle holder of claim 1 wherein said plastic sheet is formed to provide means for holding saddles having different flap lengths.

4. The portable saddle holder of claim 3 wherein said flaps have an underside and wherein said means for supporting said saddle comprises means for contacting the underside of the flaps of said saddle.

5. The portable saddle holder of claim 1 further comprising means for compactly storing said portable saddle holder.

6. The portable saddle holder of claim 5 wherein said means for compactly storing said portable saddle holder comprises means for nestling a plurality of said saddle holders together.

7. The portable saddle holder of claim 6 wherein said portable saddle holder has flexible sides and wherein said means for nestling said saddle holders together includes the flexible sides of said portable saddle holder.

8. The portable saddle holder of claim 1 wherein said means for holding saddles with different tree widths and associated panel spacings comprises a portion of the cross section of said portable saddle holder.

9. The portable saddle holder of claim 8 wherein said cross section has an upper portion and wherein the portion of the cross section of said portable saddle holder forming means for holding saddles with different tree widths and associated panel spacings includes the upper portion of said cross section.

10. The portable saddle holder of claim 9 wherein the upper portion of said cross section is shaped to form part of the circumference of a circle with a radius R1 and said radius R1 is related to the saddle panel spacings W as follows:

$$R1=B(W/2)$$

$$1.15 \leqq B \leqq 3.25.$$

11. The portable saddle holder of claim 10 wherein part of the circumference of said circle is formed by an arc between 35 degrees and 45 degrees.

12. The portable saddle holder of claim 9 wherein said cross section has an arch with an apex and said portable saddle holder has bottom edges forming a plane and wherein the distance from the apex of said arch to the plane formed by the bottom edges of said portable saddle holder L1 is as follows:

$$L1=A \times L$$

$$1.10 \leqq A \leqq 1.57$$

where: L is the expected flap length of the saddle to fit on said portable saddle holder.

13. The portable saddle of claim 13 further comprising means for permitting said portable saddle holder to be carried on the forearm of a person.

14. The portable saddle holder of claim 1. wherein said cross section has an upper portion and wherein said means for permitting said portable saddle holder to be carried on the forearm of a person includes said upper portion.

* * * * *